US007744808B2

(12) United States Patent
Tenzek

(10) Patent No.: US 7,744,808 B2
(45) Date of Patent: Jun. 29, 2010

(54) SYSTEM AND METHOD FOR PRODUCING SHOT FROM MOLTEN MATERIAL

(75) Inventor: Anthony M. Tenzek, Hanoverton, OH (US)

(73) Assignee: Ajax Tocco Magnethermic Corporation, Warren, OH (US)

( * ) Notice: Subject to any disclaimer, the term of this patent is extended or adjusted under 35 U.S.C. 154(b) by 235 days.

(21) Appl. No.: 12/015,207

(22) Filed: Jan. 16, 2008

(65) Prior Publication Data

US 2009/0145265 A1 Jun. 11, 2009

Related U.S. Application Data

(60) Provisional application No. 61/012,681, filed on Dec. 10, 2007.

(51) Int. Cl.
*B22F 9/08* (2006.01)

(52) U.S. Cl. ..... 266/202; 266/217

(58) Field of Classification Search ..... None
See application file for complete search history.

(56) References Cited

U.S. PATENT DOCUMENTS 3,663,206 A * 5/1972 Lubanska ..... 75/337
3,970,249 A * 7/1976 Singer ..... 239/102.1
4,272,463 A * 6/1981 Clark et al. ..... 75/337
5,480,097 A * 1/1996 Carter et al. ..... 239/296
6,334,884 B1 * 1/2002 Tornberg ..... 75/337
6,432,330 B1 8/2002 Hanabe et al.
6,773,246 B2 * 8/2004 Tsao et al. ..... 425/6
6,784,079 B2 8/2004 Wakamatsu et al.
7,001,543 B2 2/2006 Kitahara et al.
7,300,518 B2 11/2007 Fukatsu et al.

* cited by examiner

*Primary Examiner*—George Wyszomierski
(74) *Attorney, Agent, or Firm*—Fay Sharpe LLP

(57) ABSTRACT

Systems and methods are presented for producing shot from molten material, in which two or more sprays of inert gas, such as an upper or primary spray followed by one or more lower or secondary sprays, are used to break apart large molten droplets into shot as the molten material is dropped from a crucible orifice. The upper or primary gas feed in one application acts to initially break the stream or droplets into initial droplets of a lesser size or to flatten the droplets, with the second spray then breaking up the intermediate droplets into yet smaller shot particles to be cooled and collected.

23 Claims, 6 Drawing Sheets

SYSTEM AND METHOD FOR PRODUCING SHOT FROM MOLTEN MATERIAL

REFERENCE TO RELATED APPLICATION

This application claims priority to and the benefit of U.S. Provisional Patent Application Ser. No. 61/012,681, filed Dec. 10, 2007, entitled METHOD FOR PRODUCING SHOT FROM MOLTEN MATERIAL, the entirety of which is hereby incorporated by reference.

FIELD OF THE INVENTION

The present disclosure relates generally to the production of shot and more particularly to systems and methods for producing shot from molten material.

BACKGROUND OF THE INVENTION

Small bee-bee size silicon shot is often used in the manufacture of various semiconductor products, such as solar or technical grade silicon. The shot is produced in one application by initially melting a 3" to 5" chunks of silicon material via induction or other heating technology, and pouring the molten material into a tundish or crucible with a small hole or orifice in the bottom. The molten silicon flows through the orifice either by gravity or by applying a differential pressure to the orifice (positive pressure to the molten silicon surface or a vacuum under the bottom orifice). The molten silicon is cooled prior to collection or packaging, such as by a "water quench" or other technique. By controlling the size of the orifice and/or the differential pressure, the fluid flow through the orifice breaks up into molten beads according to governing laws and the Raylaigh phenomena with respect to the buoyancy, viscosity, and the thermal diffusivity within the fluid. However, silicon has a very high surface tension. As a result, the initial droplets are typically too large for the desired shot size, for example, being on the order of 5 to 10 mm while the desired shot size may be 0.1 mm to 4.0 mm in many applications. Accordingly, the beads must be broken up to form smaller particles, known as shot formation, prior to cooling and collection, where it is desirable to provide uniformity in the size distribution of the final cooled silicon shot particles.

The melting, shot formation, and cooling operations, moreover, ideally must prevent or inhibit contamination of the silicon material. In the case of solar grade or technical grade silicon for many applications, such as those using semiconductor crystal pullers, there are many fabrication specifications such as shot purity, where typical purity requirements range from parts per million to parts per billion. In particular, Boron and Phosphorous or other "p" or "n"-type dopant impurities are undesirable, as these impurities can contaminate or adversely dope the material so as to affect the current generating capability as in the photo voltaic industry, or such impurities may inhibit the proper formation of complete crystals for technical grade silicon used in the semiconductor industry. Ideally, the molten silicon should not come into contact with any materials other than primarily quartz or graphite for these applications.

Conventional shot formation and cooling techniques often result in formation of various residues on the surface of the shot. Water quenching, in this regard, is expensive in view of the impurity requirements as the cooling water has to be recycled to eliminate impurities. When cooling with water, moreover, the resulting shot has been found to be very porous and may include entrapped water vapor or other gasses.

Attempting to remelt such material in subsequent applications often results in undesirable sputtering and spitting. Water quench, moreover, generally fails to provide controllable shot size and uniform size distribution. Conventional attempts at using high pressure gas for atomization typically yield shot product that is entirely too small for subsequent processes, generally in the micron range, and this technique has heretofore been subject to impurities. Moreover, prior gas cooling attempts fail to provide uniform size distribution, and instead typically yield a wide variation of droplet sizes in which the smaller particles may be characterized as a spray. In addition, the use of cooling air is undesirable because it will generally oxidize the silicon shot, thereby reducing its utility in technical or solar grade silicon applications.

Thus there remains a need for methods and systems for non-contact heat transfer to break the molten material beads into smaller particles, cool the material, and to transport it to a collection area in a controlled fashion to minimize exposure to impurities while providing uniform particle size distribution.

SUMMARY OF INVENTION

One or more aspects of the disclosure are now summarized to facilitate a basic understanding of the disclosure, wherein this summary is not an extensive overview of the disclosure, and is intended neither to identify certain elements of the disclosure, nor to delineate the scope thereof. The primary purpose of the summary, rather, is to present some concepts of the disclosure in a simplified form prior to the more detailed description that is presented hereinafter. The present disclosure relates to methods and systems for producing shot from molten material that may be advantageously employed in association with preparing silicon shot or shot made from other molten starting materials, to achieve improved control over particle size distribution uniformity and material contamination as well as control of impurity levels compared with conventional shot production techniques.

In accordance with one or more aspects of the disclosure, a system is provided for producing shot from molten material. The system includes a molten material container with an orifice or lip from which initial molten material droplets fall along a vertical axis, as well as a multilevel gas feed apparatus below the container to break the initial droplets into secondary droplets and then into still smaller shot particles, along with a collecting structure below the gas feed apparatus to collect the shot particles. The multilevel gas feed apparatus includes two or more vertically spaced gas feed mechanisms, the first of which having two or more gas outlets outlying the axis under the container that direct gas flow toward the axis to impact the initial droplets to form secondary droplets of the molten material. The second gas feed mechanism is positioned below the first feed mechanism and includes two or more gas outlets laterally spaced from the axis for directing gas flow toward the axis to impact the secondary droplets to form shot particles of the molten material. Further gas feed mechanisms can be provided to sequentially impart gas flow on the molten material as the droplets fall vertically between the container and the collection structure to yield particles of the desired dimensions with good size uniformity. The gas flow may utilize Argon or other inert gas so as to inhibit introduction of impurities or oxidation in the finished shot, wherein the gas flow rates of the upper and lower gas feeds may be separately controlled to facilitate precise control over the secondary droplet and final shot particle sizes for a given initial droplet size and material.

In one implementation of the shot production system, the upper and lower gas feed mechanisms individually include a plurality of gas outlets directing gas flow toward the axis from different directions. The gas outlets may be of any suitable form, such as outlet passages of a circular structure surrounding the vertical droplet axis, or a series of tubes with open ends facing the axis, or of suitable nozzles with preferentially designed apertures to control spray patterns, angular dispersion and thicknesses, or where the tube ends may be flattened to provide elongated openings for directing gas flow toward the axis. The gas may be directed toward the axis from one or both of the upper and lower mechanisms, moreover, at a downward angle, with the angles of the upper and lower mechanisms being separately controllable, along with separate gas flow rate control, to facilitate improved controllability of final shot particle size and uniformity. Moreover, the lateral spacing between the gas outlets and the axis may be different for the upper and lower gas feed mechanisms. In one implementation, the first downward angle is preferably greater than the second downward angle, and the lower gas outlets are farther from the axis than the upper outlets. The gas outlets of the first gas feed mechanism, moreover, may be vertically aligned to be directly above the gas outlets of the second gas feed mechanism, or these may be staggered such that none of the upper gas outlets are directly above any of the lower gas outlets, whereby the particle breaking is further controllable to achieve the desired particle size with good uniformity.

In accordance with further aspects of the disclosure, a method is provided for producing shot from molten material. The method includes creating a stream of initial droplets of molten material falling along a vertical axis, directing a first gas flow toward a first region along the axis to impact the initial droplets to form secondary droplets of the molten material, and directing a second gas flow toward a second region along the axis below the first region to impact the secondary droplets to form shot particles of the molten material, where the first and second gas flows in certain implementations are inert gas flows. One or both of the first and second gas flows may be directed at a downward angle, where the angles of the first and second flows may be different. In addition, gas flow rates of the first and second flows may be different. In so controlling these variables and in conjunction with the thermal characteristics, including the surface tension of the molten material, promotes the formation of semi-molten spheroids of a more uniform size distribution.

BRIEF DESCRIPTION OF THE DRAWINGS

The following description and drawings set forth certain illustrative implementations of the disclosure in detail, which are indicative of several exemplary ways in which the principles of the disclosure may be carried out. The illustrated examples, however, are not exhaustive of the many possible embodiments of the disclosure. Other objects, advantages and novel features of the disclosure will be appreciated from the following detailed description of the disclosure when considered in conjunction with the drawings, in which.

DETAILED DESCRIPTION OF THE INVENTION

Figure 1:
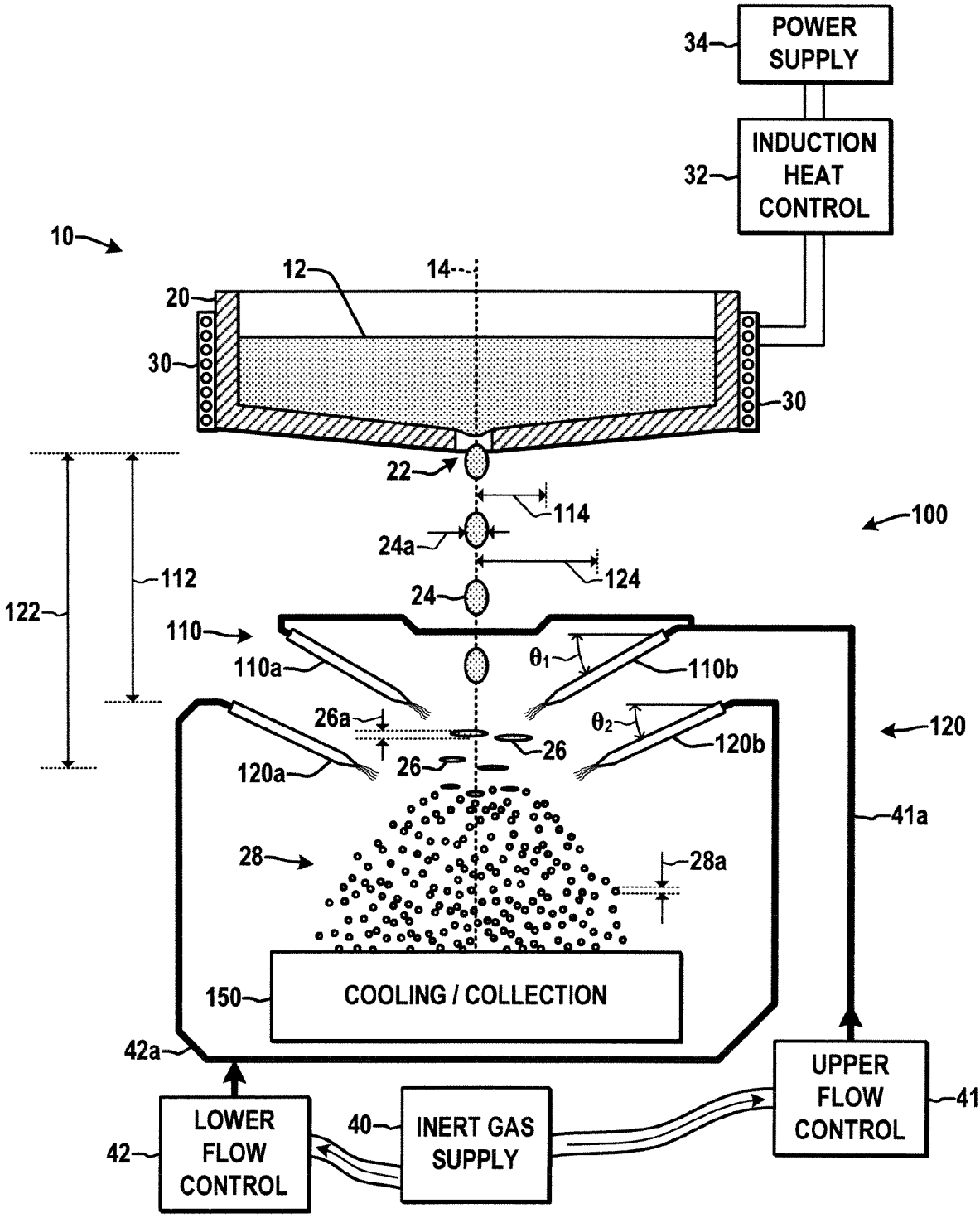
FIG. 1 is a partial schematic side elevation view in section illustrating an exemplary shot production system with a multilevel gas feed apparatus in accordance with one or more aspects of the present disclosure.

Referring now to the figures, several embodiments or implementations of the present disclosure are hereinafter described in conjunction with the drawings, wherein like reference numerals are used to refer to like elements throughout. The disclosure provides shot production systems and methods that employ two or more vertically spaced sprays of inert gas, such as an upper or primary spray followed by one or more lower or secondary sprays to impact molten material dropped from a container orifice by which the above mentioned and other deficiencies of conventional shot formation techniques may be mitigated or overcome.

FIG. 1 illustrates an exemplary system 10 for producing shot 28 from molten material 12 in accordance with the present disclosure, where the illustrated embodiment begins with initially molten silicon 12 to produce generally spherical finished silicon shot particles 28 preferably in the range of 0.1 to 4.0 mm diameter in one embodiment or with a concentration within a specified distribution within that range upon control of process flow pressure and apparatus logistics parameters as part of in the design of a given system in accordance with the various aspects of the invention. The system 10 can be employed for creating finished shot particles of other materials, such as other semiconductors or other molten material 12 generally, wherein the disclosure is not limited to the illustrated embodiments with regard to shot material content. The system 10 includes a crucible container 20 storing molten silicon material 12, where molten material 12 may be melted by a separate apparatus (not shown) and poured into the container 20, and/or the container 20 may be equipped with heating apparatus for heating the molten contents 12. In the illustrated implementation, the container 20 includes induction heating apparatus with coils 30 proximate the sidewalls of the container 20 to provide induction heating of the container walls, with the coils 30 being operated using power from a power supply 34 via an induction heat control system 32. Other forms of heating apparatus may alternatively be employed in the system 10, wherein all such alternative implementations are contemplated as falling within the scope of the present disclosure and the appended claims.

The container 20 includes an orifice 22, which may be of any suitable shape and size, where the orifice 22 is located along a vertical system axis 14. In the illustrated embodiment, the orifice 22 is generally circular allowing initial droplets 24 of molten material 12 having an initial width 24*a* of about 5.0 to 10.0 mm to form and fall along the axis 14. Other orifice shapes and sizes can be used depending upon the initial droplet size 24*a* desired for a given molten material 12, wherein the system 10 may include pressure control apparatus (not shown) for controlling the pressure of the material 12 in the container 20 and/or for controlling the pressure beneath the orifice 22 to provide a controlled differential pressure to facilitate formation of molten droplets 24. The size of the orifice 22, the temperature of the molten material 12, and the various operational parameters associated with the shot particle formation system 10, as well as the structural and operational parameters associated with a gas feeding system 100 described further hereinafter can be selected to tailor the system 10 for producing shot particles 28 of a given desired final size while mitigating impurities.

Below the container 20 is a multilevel gas feed apparatus 100 in accordance with the present disclosure, including two (e.g., upper and lower) gas feed mechanisms 110 and 120 that provides two levels of inert gas spray directed toward select regions 116 and 126 (FIG. 2 below) of and about the vertical axis 14. In operation, the multilevel gas flow from the apparatus 100 operates on the falling molten material to reduce the particle size from the size 24*a* of the initial droplets 24 to that (28*a*) of the finished shot particles 28, where the first (upper) spray impacts the initial droplets 28 to flatten and/or break the droplets into secondary droplets 26, which are then broken into smaller pieces to form the final shot 28. The resulting shot particles 28 are cooled to solidify and collected in a collection structure 150. In the embodiment of FIG. 1, a dual level gas feed apparatus 100 is provided, whereas further levels may be added, as illustrated and described below in connection with FIG. 6.

As further shown in FIG. 1, the exemplary gas feed apparatus 100 is comprised of a first gas feed mechanism 110 located at a first level below the container 20 having a plurality of tubes with flattened ends providing gas outlets 110*a*, 110*b* for directing gas flow toward the axis 14 to impact the initial droplets 24 to form secondary droplets 26 of the molten material 12. Any integer number of outlets may be provided in the first gas feed mechanism 110 within the scope of the present disclosure. The apparatus 100 further includes a second gas feed mechanism 120 located below the first mechanism 110 that provides gas outlets 120*a*, 120*b* for directing a second level of inert gas flow toward the axis 14 to impact the secondary droplets 26 and thereby form shot particles 28 of the molten material 12. As with the first level, any integer number of gas feed outlets may be provided in the second mechanism 120 within the scope of the present disclosure. In the illustrated embodiment, multiple gas outlets are provided in each of the upper and lower gas feed mechanisms (e.g., outlets 110*a* and 110*b* in the upper mechanism 110, and outlets 120*a* and 120*b* in the lower mechanism 120 as depicted in FIG. 1), such that the outlets on each level individually direct gas flow toward the axis 14 from different directions. Other embodiments are possible in which one or both of the mechanisms 110, 120 include only a single outlet, for example, as illustrated and described with respect to FIG. 5 below.

The gas is provided to the tubes 110*a*, 110*b*, 120*a*, and 120*b* via upper and lower flow control systems 41 and 42, respectively, from a gas supply 40, with hoses or other gas transfer connections from the gas supply 40 to the flow control systems 41 and 42, and with gas lines 41*a*, 42*a* from the flow controls to the upper and lower gas outlet tubes 110 and 120, respectively. In this regard, the tubes providing the gas outlets and any intervening hoses or other plumbing may be formed in any suitable manner to accommodate transfer of the gas from the flow controls 41, 42, and the flow controls 41, 42 may be simple valves or more sophisticated flow controllers by which the respective first and second flow rates for the upper and lower gas feed mechanisms 110 and 120 can be individually adjusted such that the first and second gas flow rates can be the same or may be different, including controlled pulsed provision of gas via one or both of the mechanisms 110, 120. The supplied gas is preferably Argon or other inert gas, although any suitable gas can be used which operates to controllably impact the falling droplets 24 to form the particles 28 of a desired size 28*a* without adversely introducing impurities into the shot 28, such as generally spherical particles 28 having a diameter 28*a* of about 0.3 to 3.0 mm in the illustrated implementation.

In addition, the exemplary tubes 110*a*, 110*b*, 120*a*, and 120*b* are crimped or otherwise at least partially flattened to provide elongated openings for controlled provision of inert gas flow toward the axis 14 and select regions proximate the axis 14. In this regard, the upper and lower gas outlets may be formed differently to provide different flow patterns, and the separate controls 41 and 42 provide adjustability of the upper and lower gas flow rates, such that the gas interaction with the initial, secondary, and final droplets/particles 24, 26, and 28 can be tailored to provide good particle size uniformity for a given set of specifications regarding molten material properties, initial droplet size 24*a*, and a given desired final particle size 28*a*. Such tailoring may include commercially available nozzles designed with slits or orifices to produce gas jet streams of sufficient velocity, patterns, and thickness as to interact with the droplets and each other to promote turbulence for droplet break-up and reformation of required shot size distribution.

The collecting structure 150 is located along the axis 14 below the gas feed apparatus 100 to collect the shot particles 28, where the cooling of the particles 28 to form solidified shot product can occur wholly or partially during the decent from the container 20 via control of the temperature of the atmosphere under the container 20 and/or via the gas flows themselves. The collecting structure 150, moreover, can optionally be equipped with liquid coolant in which the particles 28 fall to perform most or all of the cooling from liquid to solid state, wherein such liquid coolant is preferably selected so as to avoid contamination or other disturbance of the material properties, shape, and size of the formed shot particles 28. Any suitable container or other structure can be employed as a collecting structure 150 in the system, which provides for collection or accumulation of the shot 28, such as a bin or other container having an upwardly facing full or partial opening.

The gas feed mechanisms 110 and 120 may be constructed to direct the respective upper and lower gas flows toward the droplets and particles 24, 26, 28 along or proximate the axis 14 at a controllable angle relative to the horizontal. The inventor has appreciated that the direction of gas flow imparted on the falling molten droplets and particles may advantageously provide an additional degree of control over the final shot particle formation, wherein a downward gas direction may also help to mitigate excessive lateral movement of the droplets 24, 26 and/or shot particles 28 and also inhibit unwanted buildup of material 12 on the sides and/or bottom of the structure in which the system 10 is housed. Accordingly, one or both of the feed mechanisms 110, 120 in the exemplary gas feed apparatus 100 operate to direct the corresponding gas flows at a downward angle θ, with the gas outlets 110*a*, 110*b* of the first gas feed mechanism 110 being oriented as shown to direct the first or upper gas flow toward the axis 14 at a first downward angle $\theta_1$, and the gas outlets 120*a*, 120*b* of the second gas feed mechanism 120 being oriented to direct the second or lower gas flow toward the axis 14 at a second downward angle $\theta_2$. In this embodiment, moreover, the first and second downward angles $\theta_1$ and $\theta_2$ are different, with the first downward angle $\theta_1$ being greater than the second downward angle $\theta_2$. Other combinations of first and second downward angles are contemplated within the scope of the disclosure, several examples of which are illustrated and described further with respect to FIGS. 2 and 4A-6 below.

In addition, the upper gas outlets 110*a*, 110*b* are spaced a first vertical distance 112 from the orifice 22 at the bottom of the container 20, and the second outlets 120*a*, 120*b* are spaced a larger second vertical distance 122 from the orifice 22, where the distances 112 and 122 can be separately selected so as to provide another degree of control over the performance of the multilevel shot formation process.

Figure 2:
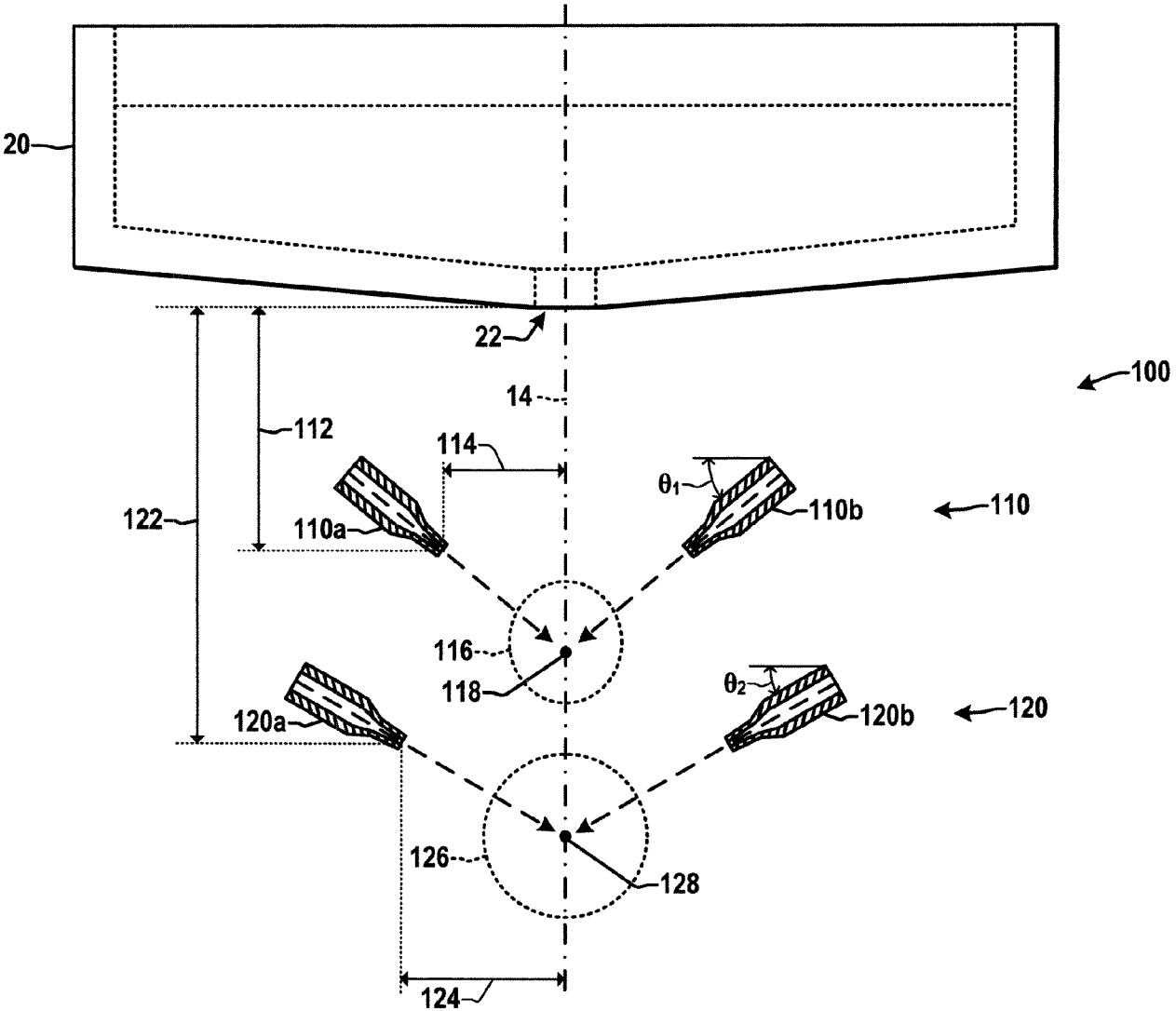
FIG. 2 is a partial side elevation view illustrating further details of the multilevel gas feed apparatus of FIG. 1.

Referring also to FIG. 2, the gas outlets 110*a* and 110*b* of the first gas feed mechanism 110 are spaced from the axis 14 by a first horizontal distance 114, while the outlets 120*a* and 120*b* of the second gas feed mechanism 120 are spaced from the axis 14 by a different horizontal distance 124 from the axis 14. In this respect, the inventor has further appreciated that the lateral spacing of the outlets 110, 120 from the center axis 14 provides a further degree of controllability of the shot formation process as a whole in providing uniform shot size, and that selective adjustment of the relative lateral spacings 114, 124 of the upper and lower gas outlets 110, 120 facilitates control over the multi-step process of breaking up the initial droplets 24 into secondary droplets 26 and then into the smaller shot particles 28. In the embodiment of FIG. 1, the lower outlets 120*a* and 120*b* are laterally farther from the axis 14 than are the upper gas outlets 110*a* and 110*b* (the second horizontal distance 124 is greater than the first horizontal distance 114).

The direction of gas flow for performing the multilevel shot formation process can be controlled using the multilevel apparatus 100 so as to create individually tailored gas flow patterns in upper and lower regions 116 and 126, respectively, along and about the vertical axis 14, as shown in FIG. 2. The individual flow rates and flow profiles within the regions 116 and 126 can be controlled through adjustment of any or all of the aforementioned lateral spacings 114, 124, the gas outlet angles $\theta_1$, $\theta_2$, the vertical spacings 112, 122 of the upper and lower gas outlets 110, 120, the upper and lower gas flow rates, and the size and shape of the upper and lower gas outlets 110*a*, 110*b*, 120*a*, and 120*b*, alone or in combination. In this regard, the impact regions 116, 126 along the axis 14 may be of any size and shape, as determined by the forgoing and other adjustment features afforded by the multilevel gas feed apparatus 100 as illustrated and described herein. Moreover, the regions 116 and 126 may, but need not, overlap within the scope of the present disclosure.

As further shown in FIG. 2, the gas outlets of either or both of the upper and lower gas feed mechanisms 110 and 120 can be set so as to point toward a given point 118, 128 along the axis 14 within the corresponding regions 116, 126, respectively, as determined by the corresponding angles $\theta_1$, and $\theta_2$, and vertical spacing distances 112 and 122. In other possible implementations, the center spray axis of two upper outlets 110*a*, 110*b* or of two lower outlets 120*a*, 120*b* may be adjusted so as to face different points on the axis such that one outlet (e.g., upper outlet 110*a*) faces a point on the axis (e.g., point 118 in FIG. 2) while another outlet (e.g., outlet 110*b*) faces a higher or lower point on the axis 14. This can be achieved, for instance, by the two outlets being disposed at different angles θ with respect to the horizontal and/or by having the two outlets disposed a different vertical distance beneath the container orifice 22 (e.g., with outlet 110*a* spaced by a first distance 112 from the orifice, and outlet 110*b* spaced a different vertical distance from the orifice 22). In this manner, the gas flow of a given gas feed mechanism 110 and/or 120 will impact the falling droplets 24, 26 in somewhat sequential fashion, thereby modifying the shape and profile of the impact regions 116, 126.

Figure 3A:
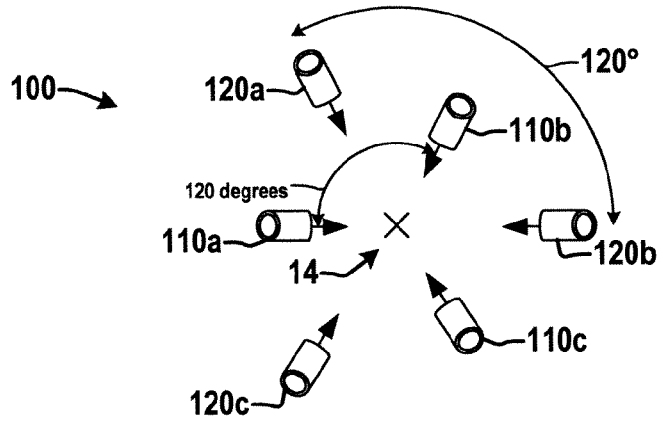
FIG. 3A is a simplified partial top plan view of one embodiment of the multilevel gas feed apparatus of FIGS. 1 and 2 in which gas outlets of upper and lower gas feed mechanisms are spaced by different lateral distances from a vertical axis along which molten material droplets fall, and in which the upper and lower outlets are staggered such that none of the gas outlets of the upper gas feed mechanism are directly above any of the gas outlets of the lower gas feed mechanism.
Figure 3B:
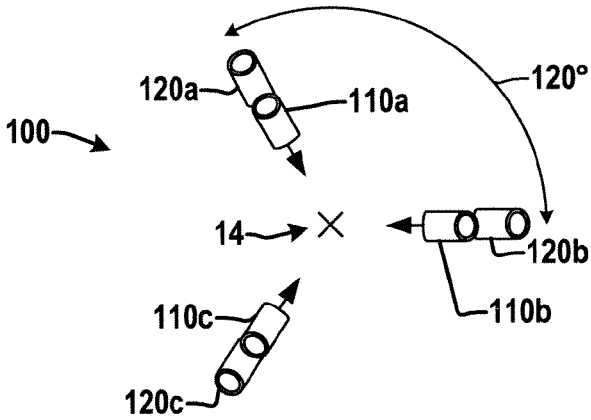
FIG. 3B is a simplified partial top plan view of another embodiment of the multilevel gas feed apparatus of FIGS. 1 and 2 in which gas outlets of upper and lower gas feed mechanisms are spaced by different lateral distances from the vertical axis, and where the upper and lower outlets are vertically aligned with gas outlets of the upper gas feed mechanism being directly above the outlets of the lower gas feed mechanism.
Figure 3C:
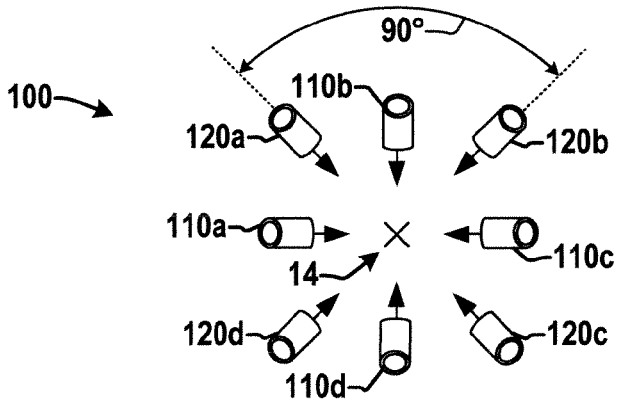
FIG. 3C is a simplified partial top plan view of yet another possible embodiment of the multilevel gas feed apparatus of FIGS. 1 and 2, wherein the gas outlets of upper and lower gas feed mechanisms are laterally spaced from the vertical axis by the same amount, with the upper and lower outlets staggered such that none of the gas outlets of the upper gas feed mechanism are directly above any of the gas outlets of the lower gas feed mechanism.

FIGS. 3A-3C illustrate simplified top plan views of other aspects of the system 100, wherein the number and relative orientation of the gas outlets 110, 120 of the upper and lower gas feed mechanisms may be adjusted to provide further control within one or both of the upper and lower regions 116 and 126 over the process of breaking the initial droplets 24 falling along the axis 14 into the finished shot particles 28. In one aspect, the gas outlets of a given level can be positioned so as to each point directly at the axis 14 (e.g., upper outlets 110*a*-110*c* in FIG. 3A each pointing at the axis 14 from locations distributed at 120 degree intervals around the periphery of the axis, and laterally equally spaced therefrom). Alternatively, one or more of the outlets on a given level can be situated so as to not point directly at the axis, and the directionality with respect to the axis 14 can optionally be set in the lower and/or upper level so as to achieve a vortex effect on the molten material in certain implementations.

In another aspect, the number of gas outlets in each level can vary from one outlet to any integer number, and the number of outlets in the upper and lower mechanisms 110 and 120 can be the same or different within the scope of the disclosure. Thus, as shown in FIG. 3A, for instance, three outlets are provided in each level including upper outlets 110*a*-110*c* and lower outlets 120*a*-120*c*, with the outlets in each level being equally spaced around the axis 14 by the same lateral distance. In this embodiment, moreover, the upper and lower gas feed outlets are spaced by different lateral distances from the axis 14 (the upper outlets 110*a*-110*c* are closer to the axis 14 than are the lower outlets 120*a*-120*c*), with the upper and lower outlets staggered in a generally complementary fashion such that none of the outlets 110*a*-110*c* of the upper gas feed mechanism 110 are directly above any of the lower outlets 120*a*-120*c*. Rather, each set of three outlets are spaced from one another by 120 degrees, and the outlets of the upper and lower mechanisms 110 and 120 are spaced from one another by 60 degrees.

FIG. 3B shows a variant implementation, in which three outlets are provided at each level, with 120 degree spacing in each level, but the upper and lower outlets are vertically aligned such that the upper gas outlets 110*a*-110*c* are directly above the lower outlets 120*a*-120*c*. Another exemplary configuration is shown in FIG. 3C, in which four outlets are provided in each level including four upper outlets 110*a*-110*d* and four lower outlets 120*a*-120*d*, with the outlets in each level being equally spaced around the axis 14 by the same lateral distance and angularly spaced from one another by 90 degrees. Like the above implementations of FIGS. 3A and 3B, moreover, the four upper outlets 110*a*-110*d* are laterally closer to the axis 14 than are the lower outlets 120*a*-120*d*. In addition, as in the example of FIG. 3A, the upper and lower outlets are spaced from one another by 45 degrees with none of the upper outlets 110*a*-110*d* being directly above any of the lower outlets 120*a*-120*d*. Other staggered offset arrangements are possible with respect to angular spacing between outlets of the same level and for angular spacing of upper and lower outlets, which may but need not be symmetrical within a given level or between different levels, wherein all such alternate implementations are contemplated as falling within the scope of the present disclosure and the appended claims.

Figure 4A:
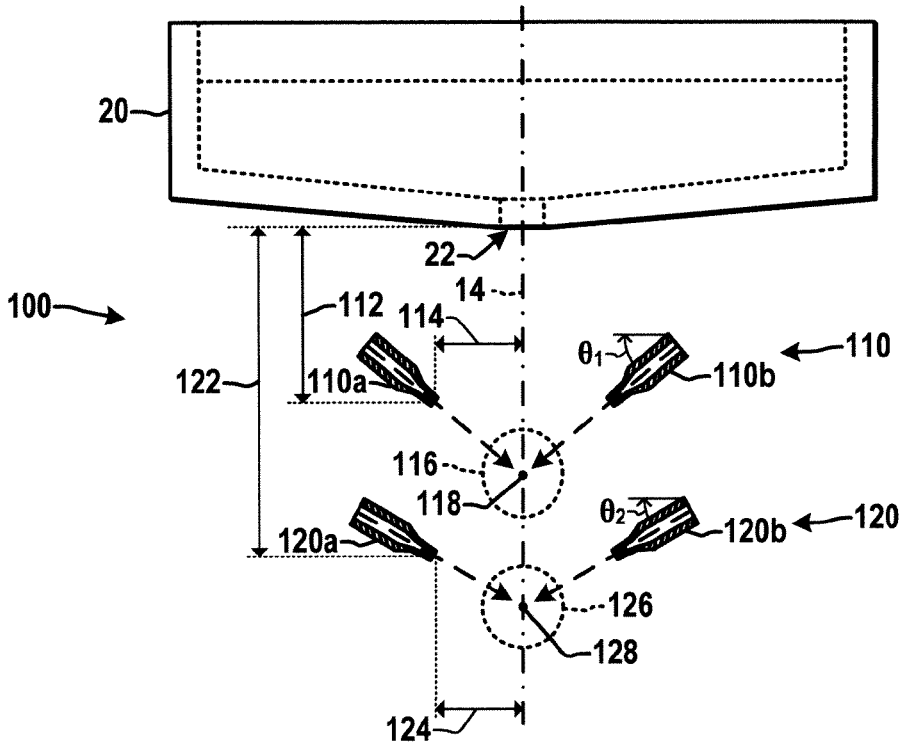
FIG. 4A is a simplified partial side elevation view of another possible embodiment of the apparatus of FIGS. 1 and 2 in which the upper and lower gas outlets are equally spaced from the vertical system axis, and direct gas toward upper and lower regions along the axis at different downward angles in accordance with other aspects of the disclosure.
Figure 4B:
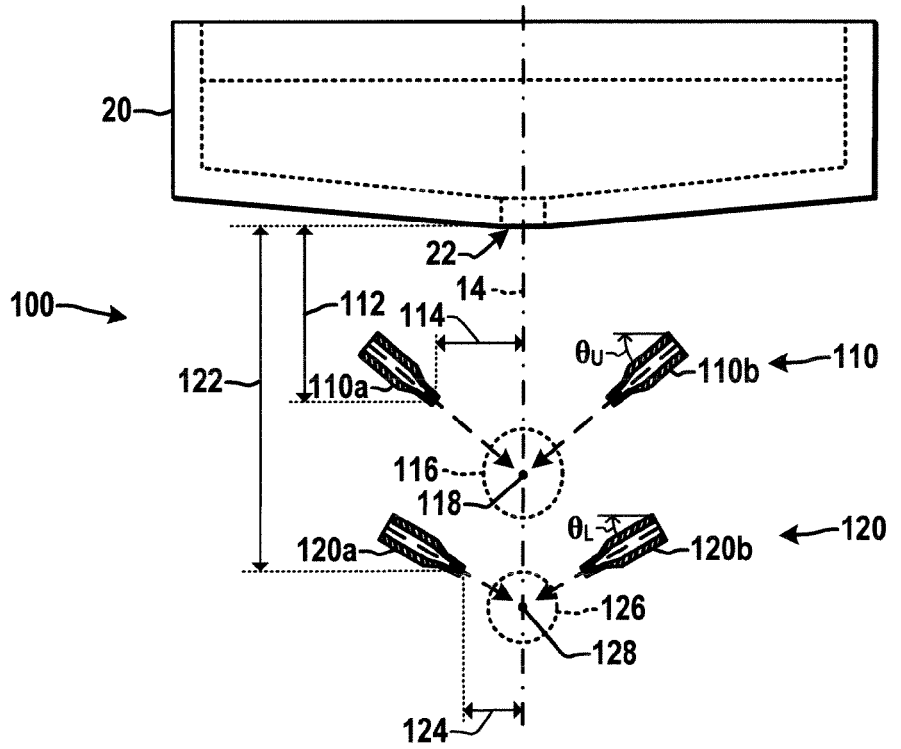
FIG. 4B is a simplified partial side elevation view of yet another possible embodiment of the apparatus of FIGS. 1 and 2 in which the upper gas outlets are spaced farther from the vertical axis than the lower gas outlets, and the gas is directed toward upper and lower regions along the axis at different downward angles.

Referring now to FIGS. 4A and 4B, as discussed above, the upper and lower gas feed mechanisms 110 and 120 may provide for any combination of lateral spacing of the gas outlets from the axis 14. In this respect, FIG. 4A depicts a generally symmetrical arrangement in which the upper and lower lateral spacing distances 114 and 124 from the axis 14 are the same, and the upper and lower outlet angles $\theta_1$ and $\theta_2$ are the same. For situations in which the upper and lower gas flows are equal, the resulting spray impact regions 116 and 126 are roughly the same. FIG. 4B shows a different embodiment in which the upper and lower angles $\theta_1$ and $\theta_2$ are again the same. In this arrangement, however, the lower outlets 120*a* and 120*b* are closer to the axis 14 than are the upper outlets 110*a* and 110*b* (the first lateral distance 114 is greater than the second lateral distance 124). Thus, the lateral spacing of the two levels may be the same, or may be different, wherein the upper spacing distance 114 may be less than, equal to, or greater than the lower spacing distance 124.

In operation of the multilevel gas feed apparatus 100, the upper gas spray from mechanism 110 acts to wholly or partially break and/or flatten/deform the stream of initial molten droplets 24 into secondary or intermediate droplets 26 of a lesser size and/or of a different shape, which may be somewhat flattened in certain embodiments. The second spray from the lower mechanism 120 then breaks up the flattened or smaller droplets 26 into yet smaller droplets or shot particles 28. As discussed above, the exemplary system 100 provides for tailoring the final shot particle size 28*a* and controlling particle size uniformity via a number of adjustment factors, including without limitation the size, shape, and number of gas feed outlets provided at each level, the individual gas flow rates or pressures at each level, the vertical spacing between the levels and the vertical distance between the gas feed apparatus 100 and the container orifice 22, the angles $\theta$ of the gas outlets at each level, the proximity of the two streams of gas to one another and the size and profile of the gas interaction regions 116, 126, wherein such factors determine the interaction of the two or more gas streams on the molten metal stream from the mechanical break-up of the initial droplets 24 to the formation and cooling of the final shot particles 28.

Figure 5:
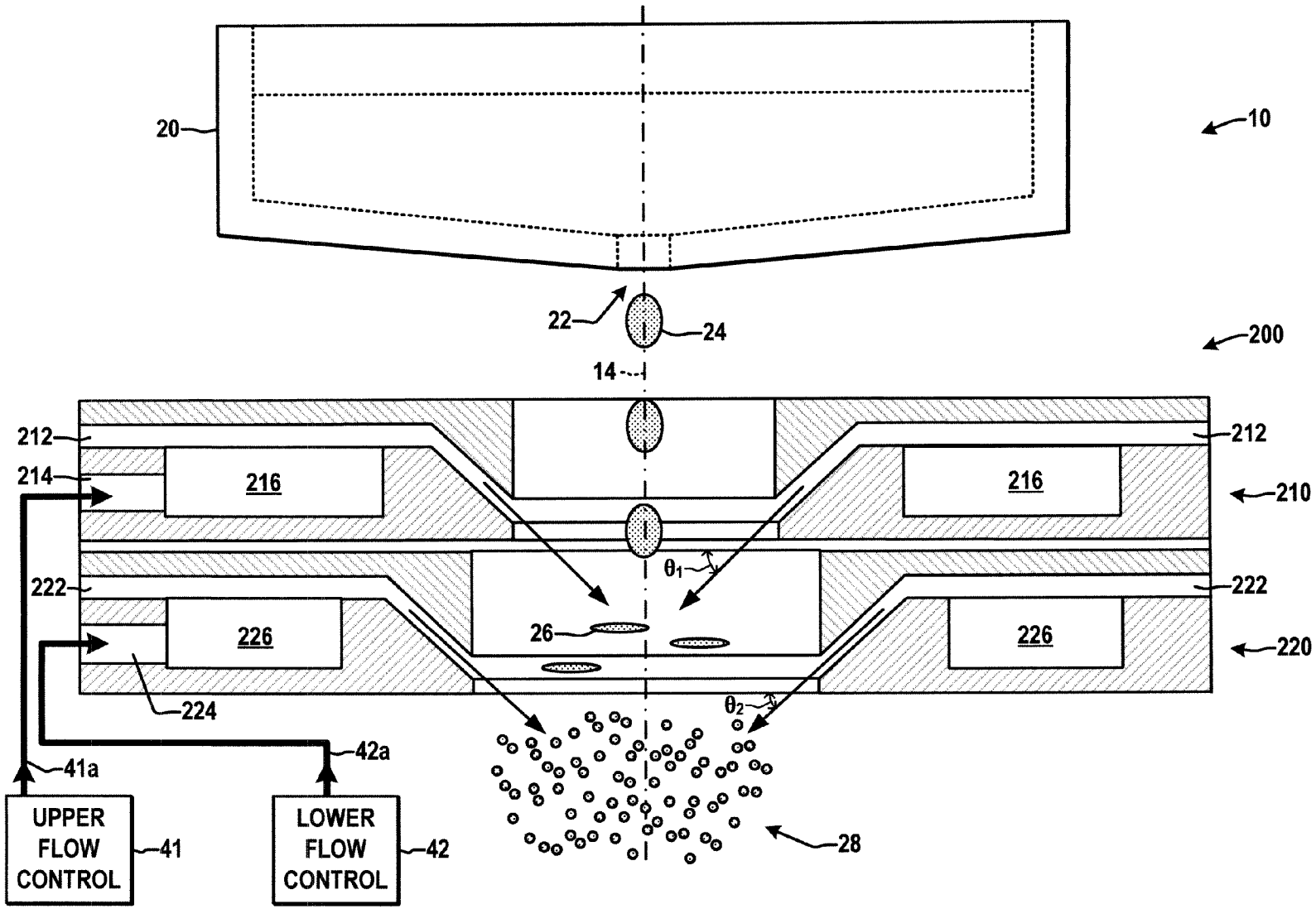
FIG. 5 is a partial schematic side elevation view in section illustrating another embodiment of a shot production system with a multilevel gas feed apparatus including a circular structure with upper and lower outlet passages surrounding the vertical axis in accordance with the present disclosure.

FIG. 5 illustrates another embodiment of a shot production system 10 with a multilevel gas feed apparatus 200 comprising a circular structure, such as machined metal with upper and lower sections 210 and 220 that provide upper and lower outlet passages 212 and 222, respectively, surrounding the vertical axis 14 in accordance with the present disclosure. In this implementation, the passages 212 and 222 individually provide intermittent circumferential slot openings to promote the required interaction of gasses with the droplets by directing inert gas downward at a downward angle ($\theta_1$ and $\theta_2$, respectively) from all directions surrounding the axis 14. In this embodiment, the first or upper outlet passage 212 is provided with Argon or other inert gas from a circular upper gas chamber ring 216 fed by an inlet passage 214 via a hose or other gas interconnection 41*a* from the upper flow control 41, and the second or lower outlet passage 222 is provided with gas from a lower ring shaped gas chamber 226 fed by the lower flow control 42 via hoses 42*a* and an inlet 224 in the lower section 220. The apparatus 200 thus provides upper and lower gas feed mechanisms 210 and 220, respectively, that include the gas outlets 212 and 222 directing inert gas flow toward vertically spaced regions along the axis 14 to impact the initial droplets 24 to form secondary droplets 26, and then to impact the secondary droplets 26 to form shot particles 28 of the material 12. The illustrated example, moreover, provides for lateral spacing of the lower outlet 222 farther from the axis 14 than the lateral spacing of the upper outlet 212. Like the above examples of FIGS. 1-4B, the double ring approach with downward gas direction in FIG. 5 advantageously directs the produced shot 28 downward into the cooling mechanism, causing the shot break-up to occur below the apparatus 200 so as to mitigated unwanted build-up on system components.

Figure 6:
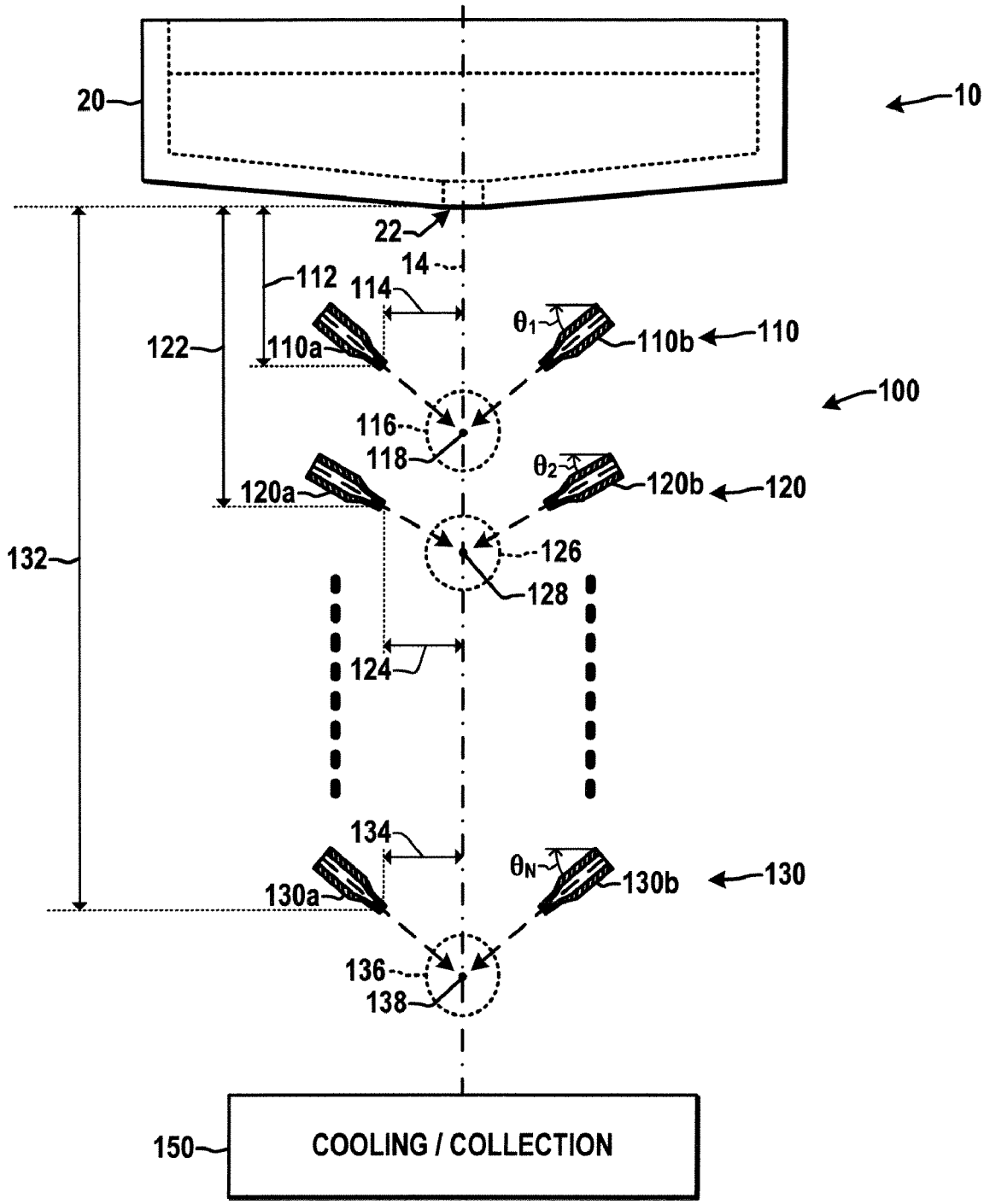
FIG. 6 is a simplified partial side elevation view of another possible embodiment of the apparatus of FIGS. 1 and 2 in which three or more levels of gas feed outlets are provided along the vertical system axis for forming final shot particles from initial molten material droplets in accordance with the present disclosure.

FIG. 6 illustrates another possible embodiment of the apparatus of FIGS. 1 and 2 having three or more levels of gas feed outlets 110, 120, 130 along the vertical system axis 14 for forming final shot particles 28 from initial molten material droplets 24 in accordance with the present disclosure. As illustrated in this example, any integer number N levels of gas spray can be provided at different vertical locations along or about the axis 14, where N is an integer greater than 1 within the scope of the present disclosure. As with the previously described embodiments, lateral spacing distances 114, 124, 134 between the outlets and the axis 14 may be the same or different for the gas feed mechanisms 110, 120, 130 of the different vertical levels in the system 10, and the gas may be directed from each mechanism 110, 120, 130 at any angle $\theta_1$, $\theta_2$, $\theta_N$ relative to the horizontal, which may be the same or different. The system 10 further provides for individually adjustable gas flow rates of the different levels, and the outlet sizing and profile may be set to provide any desired gas flow pattern for the given levels. In addition, the number of gas outlets at each level, their relative orientation and configuration may be set according to the above described aspects such that the flow rates and flow profiles can be set in each of the corresponding target gas impact regions 116, 126, and 136 associated with the gas feed mechanisms 110, 120, 130 of the different vertical levels in the system 10.

As noted above, the system 10 can be operated to achieve improved controllable shot particle production beginning with molten silicon or other material. In this regard, the present disclosure contemplates truly novel shot production process or method that includes creating a stream of initial droplets 24 of molten material 12 falling along a vertical axis 14, directing a first gas flow toward a first region 116 along the axis 14 to impact the initial droplets 24 and form secondary droplets 26, and directing a second gas flow toward a second region 126 along the axis 14 below the first region 116 to impact the secondary droplets 26 to form shot particles 28 of the molten material 12. In certain implementations as noted above, the first and second gas flows can be inert gas flows, such as Argon. One or both of the first and second gas flows may be directed at a downward angle, the upper and lower gas flow angles may be the same or different, and the gas flow rates may be the same or different.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising".

Having thus described the invention, the following is claimed:

1. A system for producing shot from molten material, comprising:

a container storing molten material, the container comprising an orifice located along a vertical axis, the orifice allowing initial droplets of the molten material to fall along the axis; and a multilevel gas feed apparatus below the container, the gas feed apparatus comprising:

a first gas feed mechanism located below the container and having at least one gas outlet laterally spaced from the axis for directing gas flow toward the axis to impact the initial droplets at a first region to form secondary droplets of the molten material, and a second gas feed mechanism located below the first gas feed mechanism and having at least one gas outlet laterally spaced from the axis for directing gas flow toward the axis to impact the secondary droplets at a second region below the first region to form shot particles of the molten material.

2. The system of claim 1, further comprising at least one inert gas supply providing inert gas to the first and second gas feed mechanisms and individually adjustable first and second gas flow controls to control first and second gas flow rates associated with the first and second gas feed mechanisms, respectively.

3. The system of claim 2, wherein the inert gas supply provides Argon gas to the first and second gas feed mechanisms.

4. The system of claim 2, wherein the first and second gas flow rates are different.

5. The system of claim 1, wherein the first gas feed mechanism comprises a plurality of gas outlets individually directing gas flow toward the axis from different directions, and wherein the second gas feed mechanism comprises a plurality of gas outlets individually directing gas flow toward the axis from different directions.

6. The system of claim 5, wherein the gas outlets of the first gas feed mechanism and the gas outlets of the second gas feed mechanism are tubes with open ends facing the axis.

7. The system of claim 6, wherein the ends of the tubes are flattened to provide elongated openings for directing gas flow toward the axis.

8. The system of claim 6, wherein the gas outlets of at least one of the first and second gas feed mechanisms direct the gas flow toward the axis at a downward angle.

9. The system of claim 8, wherein the gas outlet of the first gas feed mechanism directs the gas flow toward the axis at a first downward angle, wherein the gas outlet of the second gas feed mechanism directs the gas flow toward the axis at a second downward angle, and wherein the first and second downward angles are different.

10. The system of claim 6, wherein at least one of the gas outlets of the first gas feed mechanism is directly above at least one of the gas outlets of the second gas feed mechanism.

11. The system of claim 6, wherein none of the gas outlets of the first gas feed mechanism are directly above any of the gas outlets of the second gas feed mechanism.

12. The system of claim 1, wherein the gas outlets of at least one of the first and second gas feed mechanisms direct the gas flow toward the axis at a downward angle.

13. The system of claim 12, wherein the gas outlet of the first gas feed mechanism directs the gas flow toward the axis at a first downward angle, wherein the gas outlet of the second gas feed mechanism directs the gas flow toward the axis at a second downward angle, and wherein the first and second downward angles are different.

14. The system of claim 13, wherein the first downward angle is greater than the second downward angle.

15. The system of claim 14, wherein the at least one gas outlet of the first gas feed mechanism is spaced a first horizontal distance from the axis, wherein the at least one gas outlet of the second gas feed mechanism is spaced a second horizontal distance from the axis, and wherein the first and second horizontal distances are different.

16. The system of claim 15, wherein the second horizontal distance is greater than the first horizontal distance.

17. The system of claim 12, wherein the at least one gas outlet of the first gas feed mechanism is spaced a first horizontal distance from the axis, wherein the at least one gas outlet of the second gas feed mechanism is spaced a second horizontal distance from the axis, and wherein the first and second horizontal distances are different.

18. The system of claim 17, wherein the second horizontal distance is greater than the first horizontal distance.

19. The system of claim 1, wherein the at least one gas outlet of the first gas feed mechanism is spaced a first horizontal distance from the axis, wherein the at least one gas outlet of the second gas feed mechanism is spaced a second horizontal distance from the axis, and wherein the first and second horizontal distances are different.

20. The system of claim 19, wherein the second horizontal distance is greater than the first horizontal distance.

21. The system of claim 1, comprising a collecting structure located along the axis below the gas feed apparatus to collect the shot particles.

22. The system of claim 21, wherein the collecting structure comprises a collection bin or other container with a cooling means to collect and change the shot particles from a liquid state to a solid state.

23. A system for producing shot from molten material, comprising:

a container storing molten material, the container comprising an orifice located along a vertical axis, the orifice allowing initial droplets of the molten material to fall along the axis;

a multilevel gas feed apparatus below the container, the gas feed apparatus comprising:

a first gas feed mechanism located below the container and having at least one gas outlet laterally spaced from the axis for directing gas flow toward the axis to impact the initial droplets at a first region to form secondary droplets of the molten material, and a second gas feed mechanism located below the first gas feed mechanism and having at least one gas outlet laterally spaced from the axis for directing gas flow toward the axis to impact the secondary droplets at a second region to form shot particles of the molten material; and the gas outlets of the first gas feed mechanism being oriented such that none of the gas outlets of the first gas feed mechanism are directly above any of the gas outlets of the second gas feed mechanism.

* * * * *